United States Patent [19]

Schluter

[11] 4,018,265

[45] Apr. 19, 1977

[54] REGENERATIVE AIR PREHEATER

[75] Inventor: Siegfried Hans-Dietmar Schlüter, Wenden, Germany

[73] Assignee: Apparatebau Rothemuhle Brandt & Kritzler, Wenden, Germany

[22] Filed: July 7, 1975

[21] Appl. No.: 593,317

[30] Foreign Application Priority Data

July 16, 1974 Germany ..... 2434101

[52] U.S. Cl. ..... 165/7; 165/DIG. 23

[51] Int. Cl.[2] ..... F28D 17/00

[58] Field of Search ..... 165/7, 4, 8, DIG. 23

[56] References Cited

UNITED STATES PATENTS

| | | | |
|---|---|---|---|
| 2,468,826 | 5/1949 | Karlsson et al. | 165/7 X |
| 2,665,120 | 1/1954 | Blomquist | 165/7 |

FOREIGN PATENTS OR APPLICATIONS

| | | | |
|---|---|---|---|
| 12,822 | 1/1966 | Japan | 165/7 |

*Primary Examiner*—Albert W. Davis, Jr.

*Attorney, Agent, or Firm*—Lockwood, Dewey, Zickert & Alex

[57] ABSTRACT

A rotary regenerative air preheater has a preliminary heating stage for the cold air, before it reaches the regenerative mass, constituted by recuperative heating surfaces provided within the ducting which brings the cold air to the regenerative mass and which are heated by exhaust gas which has passed through the regenerative mass but has lost least heat to that mass. The surfaces take e.g. the form of tubes passing through the channel and gas is guided into these tubes by a gas-catching wing extending to close to one face of the regenerative mass.

An embodiment of each of a rotating-and a stationary-mass preheater are described.

12 Claims, 4 Drawing Figures

REGENERATIVE AIR PREHEATER

FIELD OF THE INVENTION

This invention relates to rotary regenerative air preheaters both of the type where a regenerative mass is stationary and media collecting ducts rotate over the end faces of the mass and also of the type where the ducts are all stationary and the regenerative mass rotates.

BACKGROUND OF THE INVENTION

In both types of preheater a hot medium such as an exhaust gas from a boiler, is brought first into contact with a given portion of the regenerative mass and gives up heat to it; then, a cold medium to be heated, such as air, is brought into contact with that portion of the mass and takes up heat from it.

Attempts have been made to maximise the utilisation of heat from the hot medium, in relation to the cold medium to be heated, particularly from the point of view of reducing the final temperature at which the erstwhile hot medium is discharged to the surrounding atmosphere.

One manner in which this has been attempted in the past is seen from German Pat. No. 1,264,672 wherein preheating elements and economizer heating elements are arranged alternately in series, each preheater region being succeeded by one or more heat exchange regions in which preheater and economizer elements or alternatively preheater and superheater elements are disposed in juxtaposition. This amounts to a stepped arrangement of a plurality of heat exchanger regions and this results in a considerable increase in the overall volume of the installation.

SUMMARY OF THE INVENTION

The present invention is concerned with providing an additional heating stage in a rotary regenerative air preheater in a compact manner such that the overall volume of the installation need not be increased at all. The result is a heat exchanger capable of operation to extract more heat from a given exhaust gas than would have been possible for a conventional exchanger of the same size.

In accordance with the invention a rotary regenerative air preheater is provided with recuperative heating surfaces in the ducting which conducts the cooler of the media to the regenerative mass and means for contacting the hot medium with the recuperative surfaces. The surfaces preferably are formed by tubular elements of which an external face is in contact with the medium to be heated and an internal face in contact with the medium giving up heat.

Since these surfaces are provided on the ingoing side of the channel which conduct the cold medium to the regenerative mass they will provide for preliminary heating of that cold medium before it meets the regenerative mass and therefore will have the effect not only of increasing the efficiency of thermal extraction from the hot medium but also of tending to increase the temperature of the mass at its cold end, at which end there are often encountered problems of condensation leading to corrosion.

The recuperative heating surfaces will preferably be made of corrosion resistent material or at least be coated with a corrosion resistent material.

DESCRIPTION OF THE DRAWINGS

Particular embodiments of the invention will now be described with reference to the accompanying drawings wherein.

DESCRIPTION OF PREFERRED EMBODIMENTS

Figure 1:
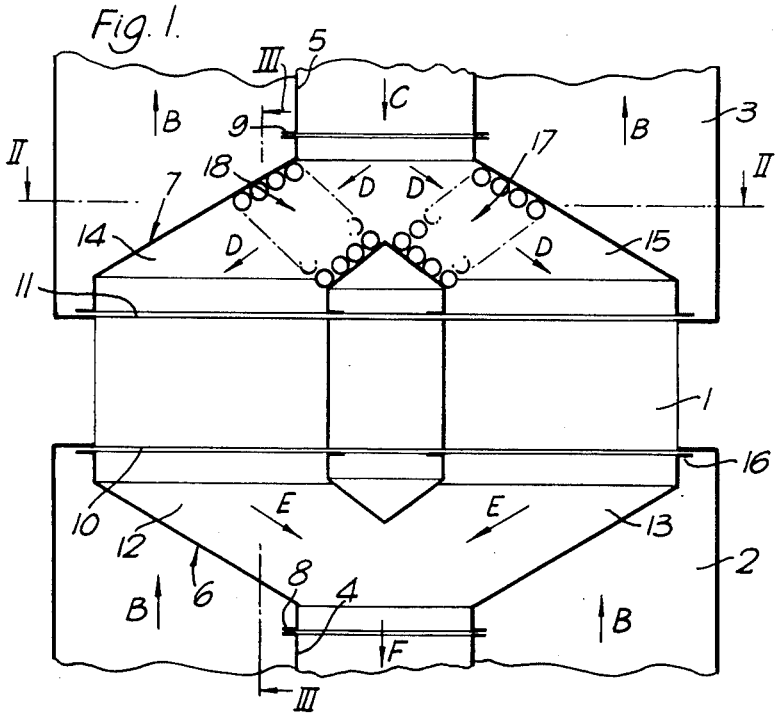
FIG. 1 is a diametrical section through a first embodiment taken on the line I—I in FIG. 2.
Figure 2:
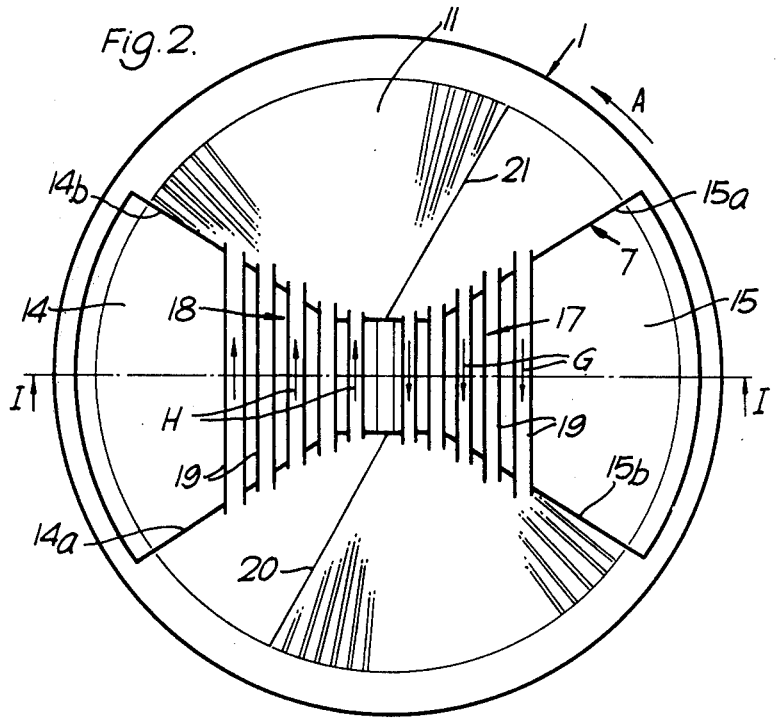
FIG. 2 is a section on the line II—II FIG. 1.
Figure 3:
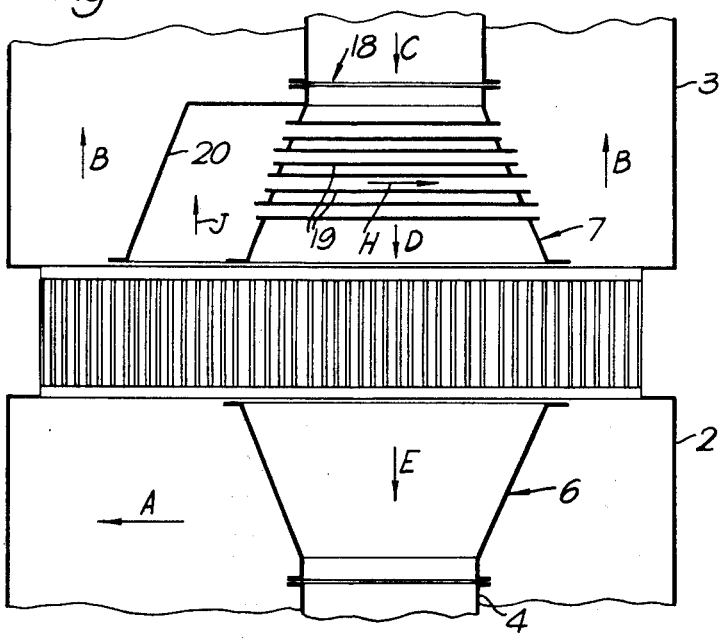
FIG. 3 is a section taken on the line III—III FIG. 1
Figure 4:
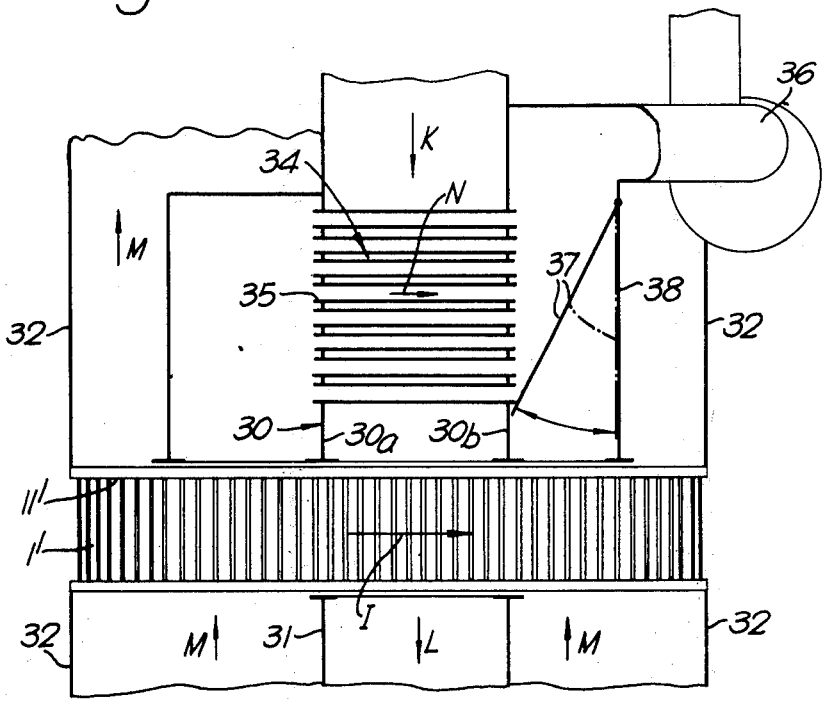
FIG. 4 is a diametrical section, analogous to FIG. 1, of a second embodiment.

The embodiment of FIGS. 1 to 3 is an illustration of rotary regenerative preheater of the type where ducts in the form of hoods rotate over end faces of a stationary heating surface whereas the embodiment illustrated in FIG. 4 is of the type where the regenerative mass rotates between stationary media-conducting channels. It will be seen that in both cases recuperative (indirect heat exchange) elements are provided in the channels which conduct the cold medium to the regenerative mass.

In the first embodiment, a stationary regenerative mass 1 of annular cylindrical form is connected to an outer, stationary medium-conducting lower passage 2 and upper passage 3. Within these there is an inner lower stationary duct 4 and upper stationary duct 5 respectively connected to rotating hoods 6, 7 through a sealed rotatable joint 8, 9. The hoods 6, 7 rotate in synchronism over respectively the lower axial end face 10 and upper axial end face 11 of the regenerative mass 1, their direction of rotation being indicated by the arrow A in FIGS. 2 and 3. Each hood has two symmetrically disposed outwardly flaring segment shaped hood portions 12, 13 and 14, 15 respectively, the end boundaries of which are sealed in substantially gas-tight fashion over the respective end faces 10, 11 of the regenerative mass by sealing frames indicated for example at 16 and which are of conventional type. In the embodiment illustrated exhaust gases flow upwardly through the stationary channels 2, 3 as illustrated by arrows B while cold air enters at arrow C moving downwardly.

The cold air enters through stationary duct 5 and then is split into the two rotating hood portions 14, 15 as indicated by arrows D, passes through the regenerative mass, leaves through rotating hood portions 12, 13 (arrows E) and is taken off through stationary duct 4 as illustrated by arrow F. By rotation of the ducts 6, 7 all parts of the regenerative mass 1 are alternatively heated by the upflowing exhaust gas which surrounds the ducts 6, 7 within the ducts 2, 3, and then cooled by the downflowing air.

To increase the efficiency of the installation and at the same time to raise the temperature of the cold end 11 of the regenerative mass the air is subjected to preliminary heating by means of arrays 17, 18 of recuperative heating surfaces which in this embodiment take the form of tubes 19 which pass through each of the hood portions 14, 15 and extend through the side walls (**14*a*,14*b*; 15*a*,15*b*) of these portions so that these tubes form a passage through the hoods for the hot gaseous medium which, in passing through the tubes 19 as illustrated by arrows G,H in FIG. 2, heats the tubes on their internal surface so that they are conditioned to give up heat to the downflowing air. The tubes 19 are preferably made of a corrosion resistent material or at least surfaced with such a material because of the problem of condensation from the exhaust gas as a result of its cooling at the internal surface of the tubes 19.**

In order to guide the hot gas flow in the direction of the arrows G and H, collection wings 20, 21 are provided in front of the loading side wall 14*a*,15*a* of each of the hood portions 14, 15, as is best seen in FIGS. 2 and 3 so as to catch gas as it emerges from the regenerative mass 1 and direct it through the array of tubes such as 18 (arrow J, FIG. 3.) The wings 20, 21 are joined to and therefore carried with the hood 7 in its rotation.

The direction of flow of the gas is assured because of the reduction of pressure which is conventionally achieved from the rotary regenerative air preheater for the purpose of drawing that gas through it and into a waste stack; and gas having passed through the tubes 19 and been further cooled thereby joins the gas flow indicated by arrow B without coming again into contact with regenerative mass.

In the embodiment seen in FIG. 4, the regenerative mass 1' is rotatable about its central axis in the direction of arrow I so that portions pass in succession between upper and lower parts 30, 31 of a stationary duct for cold air. The air flows downwardly as illustrated by arrow K through duct part 30, through a given portion of the mass 1' and then into stationary duct part 31, in which it flows as shown by arrow L. Hot gas flows upwardly, arrows M, through an outer stationary duct 32. At a portion of the upper face (the cold end) of the mass it is received in a stationary catcher 33 joined to but spaced from a side wall 30*a* of the duct part 30 which is first passed by a given portion of the rotating mass 1'. Recuperative surfaces are provided by an array 34 of tubes 35 which extend through the duct part 30 and gas may flow through them as indicated by arrow N. A second gas catcher 38 is adjacent the side wall 30*b* of the duct 30 which is passed second by any given portion of the rotating mass 1'. A suction pump 36 applies reduced pressure to draw gas through the mass 1', and a flap valve 37 acting between wall 30*b* and wall 38 can be used to regulate the amount of gas flow which passes through the tubes 35, this being at its maximum when the valve is at the position shown in full lines FIG. 4 and at its least when the valve is brought to a fully open position as indicated by dotted lines.

In each of the embodiments it is important to realise that the portion of the exhaust gas which has passed through the regenerative mass 1, or 1' and which is caught by the deflecting wing 20, 21 or, 33 is that portion of that gas which is at the highest temperature of all gases which have passed through the regenerative mass. This is because the portion of the mass which at any one time lies below that gas catching wing has previously been exposed for some period of time to the upward flow through it of the hot gas and has become heated thereby. In contrast, the portion of the regenerative mass which has just been subjected to the action of cold air such as that which lies immediately below the flap valve 37 FIG. 4 is at a lower temperature: depending on the nature of the heating surfaces and the length of dwell of the gas and air, the difference in temperature between gas emerging from the mass in front of and behind where cold air is conducted through it may be as much as between 40° and 80° C.

Depending on the volume available within the channels for the installation of the recuperative heating surfaces and also on the designed air inlet and gas output temperatures, a preliminary heating of the input air by as much as 80° C may be achieved by installations embodying the invention. This involves a very considerable lessening or complete elimination of problems associated with condensation in and corrosion of the cold end of the regenerative mass.

Although recuperative heating surfaces in the form of tubes have been shown other forms may be used for example double walled plates. Not all of the recuperative surfaces in an array of such surfaces need be identical. Preferred material for the surfaces are glass or ceramic or enamel and the recuperative heating elements may consist of cast metal such as cast-iron.

I claim:

1. Rotary regenerative air preheater comprising a cylindrical regenerative mass having a central axis, ducts for conducting heat-exchange media to and from the regenerative mass, the media being of different temperatures, means for causing relative rotation about the central axis of at least one of the ducts conducting the media and the regenerative mass, one of the said ducts being for conducting a colder one of the media and comprising side walls extending generally radially of the central axis, and preliminary heating means for the colder medium comprising recuperative heating surfaces in the said one of the said ducts extending generally tangentially of the central axis and defining a plurality of conduction passages for the hotter of the media across the duct, the passages opening in each of the said side walls whereby to contact the hotter of the media with the said surfaces.

2. Rotary regenerative air preheater as claimed in claim 1 wherein the duct for conducting the colder of the media to the mass includes a hood having an end plane in substantially gas tight relation with an axial end face of the regenerative mass, the end plane being defined by radially inner and outer walls and by side walls and the said means for contacting the hotter of the media with the said surfaces includes a gas-catching wing adjacent to and spaced from one of the said side walls for guiding gas to the said openings of the said passages.

3. Rotary regenerative air preheater as claimed in claim 2 wherein the said duct includes a portion rotatable around the central axis of the mass in a given direction of rotation so that one of the side walls is a leading wall and one a trailing wall and the gas-catching ring is joined to but spaced from the leading wall outside the duct.

4. Rotary regenerative air preheater as claimed in claim 3 wherein the said rotatable portion comprises two substantially identical, rotationally symmetrical, hoods.

5. Rotary regenerative air preheater as claimed in claim 2 wherein the ducts are stationary and the regenerative mass is rotatable about its central axis in a given direction of rotation whereby a given portion of the said mass passes first one side wall of the duct for the cooler medium and then the other of the said side walls, the gas-catching hood being joined but spaced from the said one side wall.

6. Rotary regenerative air preheater as claimed in claim 5 wherein the recuperative heating surfaces comprise open-ended hollow elements passing through the duct for the cooler medium, a first duct for the hotter medium at one end of the hollow elements and a second duct for the hotter medium at the other end of the hollow elements, the said first duct being defined by the gas-catching wing and the said second duct by a wall adjacent to but spaced from the other of the said side walls, means capable of drawing said hotter medium through both of the said ducts, and control means for varying the relative quantity of medium flowing through the said ducts.

7. Rotary regenerative air preheater as claimed in claim 6 wherein the control means is a variable obstructor in one of the said first and second ducts.

8. Rotary regenerative air preheater as claimed in claim 5 wherein suction means is associated with one side of the said passages, to draw said gas through said passages from the gas-catching wing.

9. Rotary regenerative air preheater comprising a cylindrical regenerative mass having a central axis, ducts for conducting heat-exchange media to and from the regenerative mass, the media being of different temperatures and the duct for the colder of the media including a duct part having an end plane in substantially gas-tight relation with an axial end face of the regenerative mass, means for causing relative rotation of at least the duct part and the regenerative mass about the central axis, the end plane of the duct part being defined by radially inner and outer walls and by side walls and preliminary heating surfaces in the duct part, and means for contacting the hotter of the media with the heating surfaces including a gas-catching wing adjacent to one of the said side walls and outside the duct part.

10. Rotary regenerative air preheater as claimed in claim 9 wherein the said means cause relative rotation in one predetermined direction, the said one of the said side walls being the first of said side walls to pass over a given portion of the regenerative mass and the gas-catching wing passing over the said given portion before the said one of the said side walls upon relative rotation of the duct part and mass in the said predetermined direction, whereby gas caught by the gas catching wing is that gas which has been least cooled by the regenerative mass.

11. Rotary regenerative air preheater as claimed in claim 10 wherein the recuperative heating surfaces comprise hollow, open-ended, elements sealed to and penetrating side walls of the duct part for the cooler medium to define a plurality of passages for the hotter medium through it.

12. Rotary regenerative air preheater as claimed in claim 8 wherein the elements have at least one surface formed of a corrosion-resistant material.

* * * * *